United States Patent [19]

Fluck

[11] 4,019,838

[45] Apr. 26, 1977

[54] AIR PRESSURE-ACTUATED DOUBLE-ACTING DIAPHRAGM PUMP WITH MEANS TO PRODUCE A SELECTED START-UP POSITION

[76] Inventor: Henry T. Fluck, 7735 Jolain Drive, Cincinnati, Ohio 45242

[22] Filed: Sept. 3, 1975

[21] Appl. No.: 609,954

[52] U.S. Cl. ..... 417/393; 417/404; 91/304; 91/367; 91/453

[51] Int. Cl.[2] ..... F04B 17/00; F04B 35/00; F01L 25/02; F15B 13/16

[58] Field of Search ..... 417/404, 393, 395, 397; 91/304, 320, 329, 225, 367, 453; 137/456

[56] References Cited

UNITED STATES PATENTS

| | | | |
|---|---|---|---|
| 1,741,120 | 12/1929 | Tandberg | 137/456 |
| 2,239,727 | 4/1941 | Mayer | 417/393 |
| 2,586,249 | 2/1952 | Paille | 137/456 |
| 2,625,886 | 1/1953 | Browne | 91/304 |
| 3,130,684 | 4/1964 | Firth et al. | 91/291 |
| 3,548,716 | 12/1970 | Ray | 417/393 |
| 3,741,689 | 6/1973 | Rupp | 417/404 |
| 3,838,946 | 10/1974 | Schall | 417/395 |

*Primary Examiner*—Carlton R. Croyle
*Assistant Examiner*—Thomas I. Ross
*Attorney, Agent, or Firm*—James W. Pearce; Roy F. Schaeperklaus

[57] ABSTRACT

A two-stage pump which includes a pair of reciprocating pump members operating in opposed pump chambers and a connecting rod connecting the pump members to cause the pump members to operate in unison. Air under pressure is supplied to the chambers by a spool valve member which operates in a guide sleeve. The spool valve includes four outwardly extending portions defining a central pressure slot and a pair of exhaust slots. Ports in the sleeve communicate with the pump chambers. The spool valve is moved by pressure in pressure chambers at opposite ends of the sleeve member. The sleeve is mounted in a bore, and metering air passageways are formed between the valve sleeve and the bore and connecting the pressure chambers with the exhaust slots.

3 Claims, 12 Drawing Figures

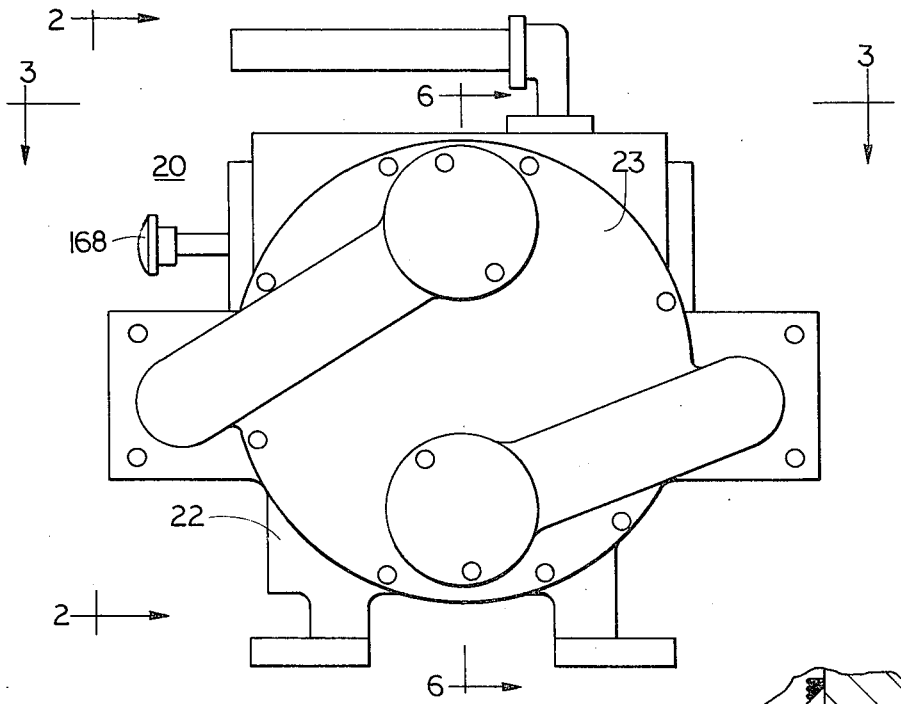
FIG. 1
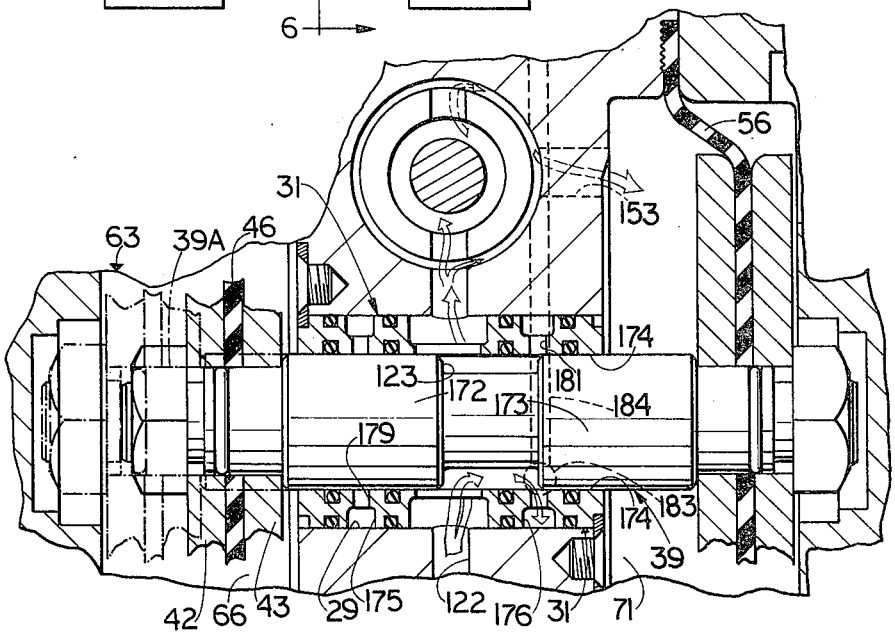
FIG. 7
FIG. 8
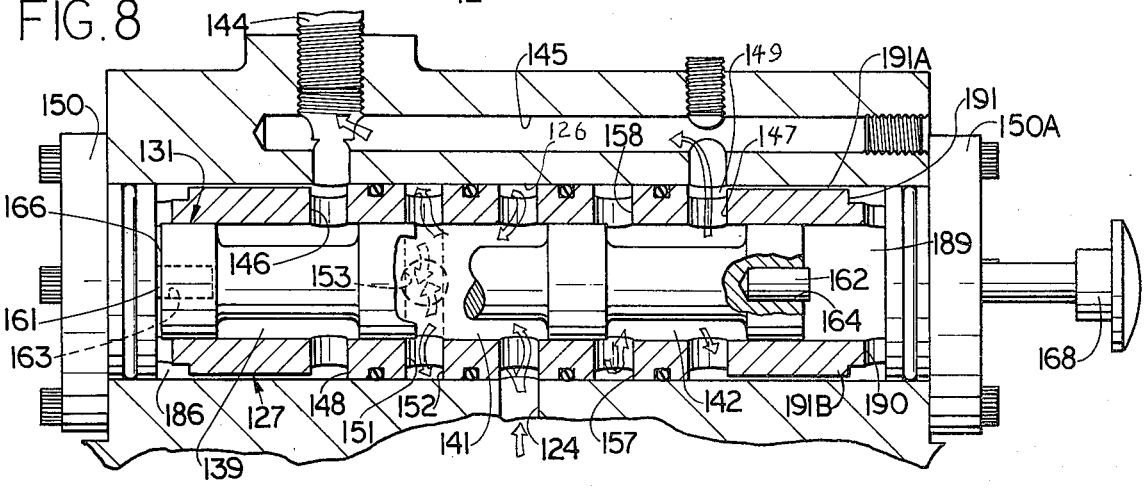

AIR PRESSURE-ACTUATED DOUBLE-ACTING DIAPHRAGM PUMP WITH MEANS TO PRODUCE A SELECTED START-UP POSITION

This invention relates to a two-stage or double-acting pump. More particularly, this invention relates to control mechanism for a double-acting pump.

Double-acting membrane pumps actuated by fluid pressure are useful in pumping gritty and abrasive material and the like. An object of this invention is to provide a simple double-acting pump and control mechanism therefor.

In a double-acting membrane pump, the membranes are linked by a connecting rod member to cause the membranes to operate in unison. A further object of this invention is to provide such a pump in which there is a central housing member which supports both the connecting rod member and a control valve.

A further object of this invention is to provide such a pump in which the control valve is freely moving under the influence of fluid pressure and in which means is provided for setting the control valve at an operative position when required to start operation of the pump.

Briefly, this invention provides a double-acting pump which includes a central housing in which a connecting rod which connects pump membranes is mounted for transverse movement. Chambers are provided on opposite sides of the main housing in which the membranes operate. Pressure is directed to the chambers alternately by a control valve which is mounted for movement in a lengthwise bore in the housing. The control valve is moved lengthwise of its bore by pressure which is directed thereto when the connecting rod is at one or the other of its extremities of movement. A plunger is provided for moving the control valve to an operative position when required to start operation of the pump.

The above and other objects and features of the invention will be apparent to those skilled in the art to which this invention pertains from the following detailed description and the drawings, in which:

FIG. 1 is a view in side elevation of a double-acting membrane pump constructed in accordance with an embodiment of this invention;

FIG. 7 is a fragmentary sectional view showing membranes and a connecting rod of the pump in one of the extreme positions of movement in full lines and in the other of its extreme positions in dot-dash lines;

FIG. 8 is a fragmentary sectional view showing a control valve of the machine in one of the extreme positions thereof, part of the control valve being broken away to show details of structure;

In the following detailed description and the drawings, like reference characters indicate like parts.

Figure 2:
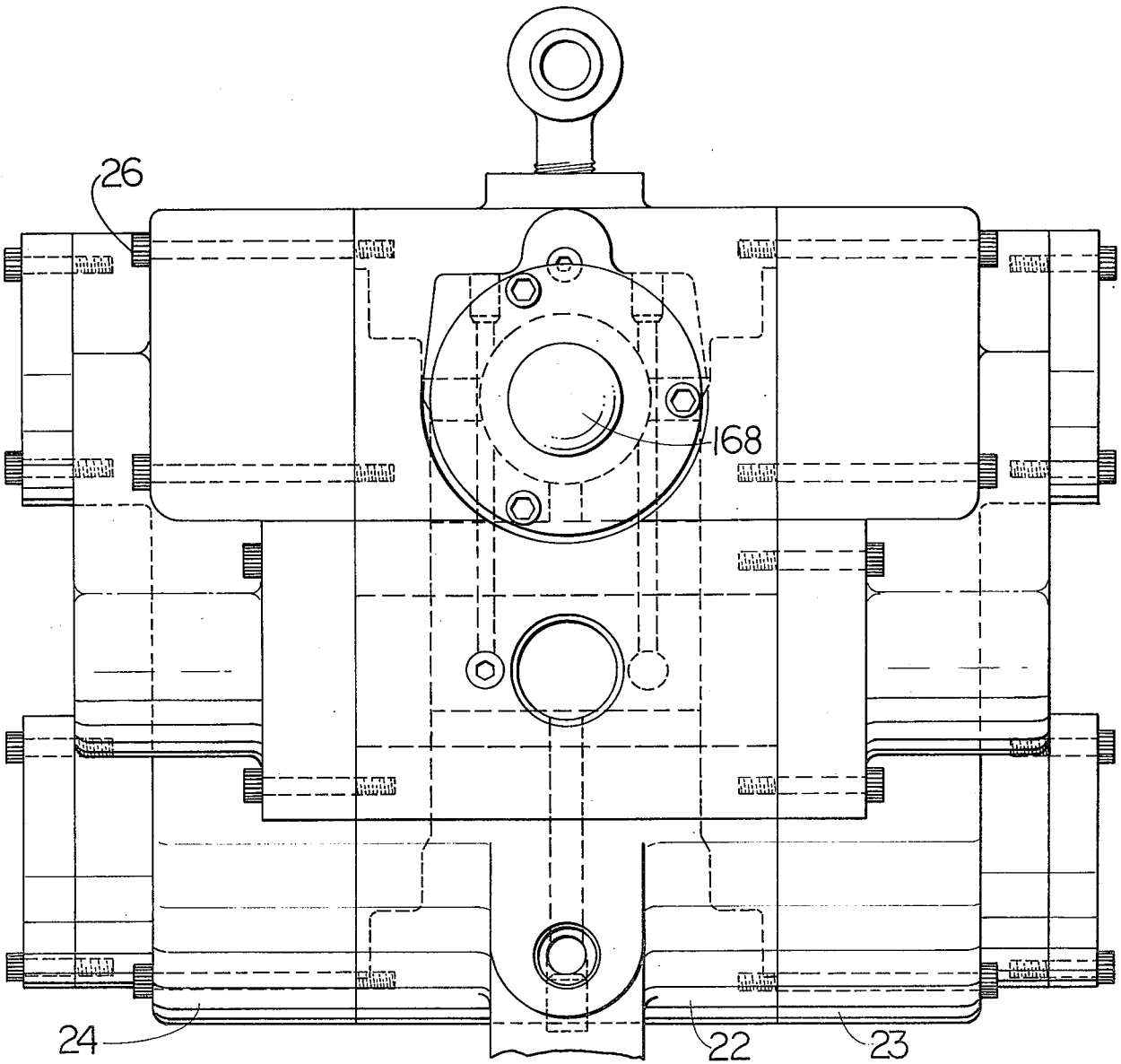
FIG. 2 is an end elevational view thereof on an enlarged scale looking in the direction of the arrows 2—2 in FIG. 1.

In FIG. 1 is shown a double-acting pump 20 constructed in accordance with an embodiment of this invention. The pump 20 includes a central housing block 22 and side housing blocks 23 and 24 (FIG. 2). The side housing blocks 23 and 24 are attached to the central housing block 22 by appropriate fasteners 26.

The central housing block 22 is provided with a transverse bore 29 (FIG. 6) in which a valve sleeve 31 is mounted. The valve sleeve 31 is held in position in the bore 29 by washers 32 and 33 which engage flanges 34 and 36, respectively, of the valve sleeve 31. The washers 32 and 33 are held in position by fasteners 37 and 38, respectively, mounted in the central housing block 22. A connecting rod 39 is slidably mounted inside the valve sleeve 31. On a left hand end portion 41 of the connecting rod 39 are mounted annular discs 42 and 43 between which a central portion of an annular flexible diaphragm 46 is clamped. A nut 48 threaded on the connecting rod 39 holds the discs 42 and 43 and the diaphragm 46 in assembled relation on the connecting rod 39. An outer edge of the diaphragm 46 is held in an annular slot 49 in the central housing block 22 with the side housing block 24 clamping the outer edge of the diaphragm 46 in the slot 49. An O-ring seal 50 forms a seal between the connecting rod 39 and the outer disc 42. In a similar manner, on a right hand end portion 52 of the connecting rod 39 are mounted annular discs 53 and 54 between which a central portion of an annular flexible diaphragm 56 is clamped. A nut 58 threaded on the connecting rod 39 holds the discs 53 and 54 and the diaphragm 56 in assembled relation on the connecting rod 39. An outer edge of the diaphragm 56 is held in an annular slot 59 in the central housing block 22 with the side housing block 23 clamping the outer edge of the diaphragm 56 in the slot 59. An O-ring seal 61 forms a seal between the outer disc 54 and the connecting rod 39.

Figure 3:
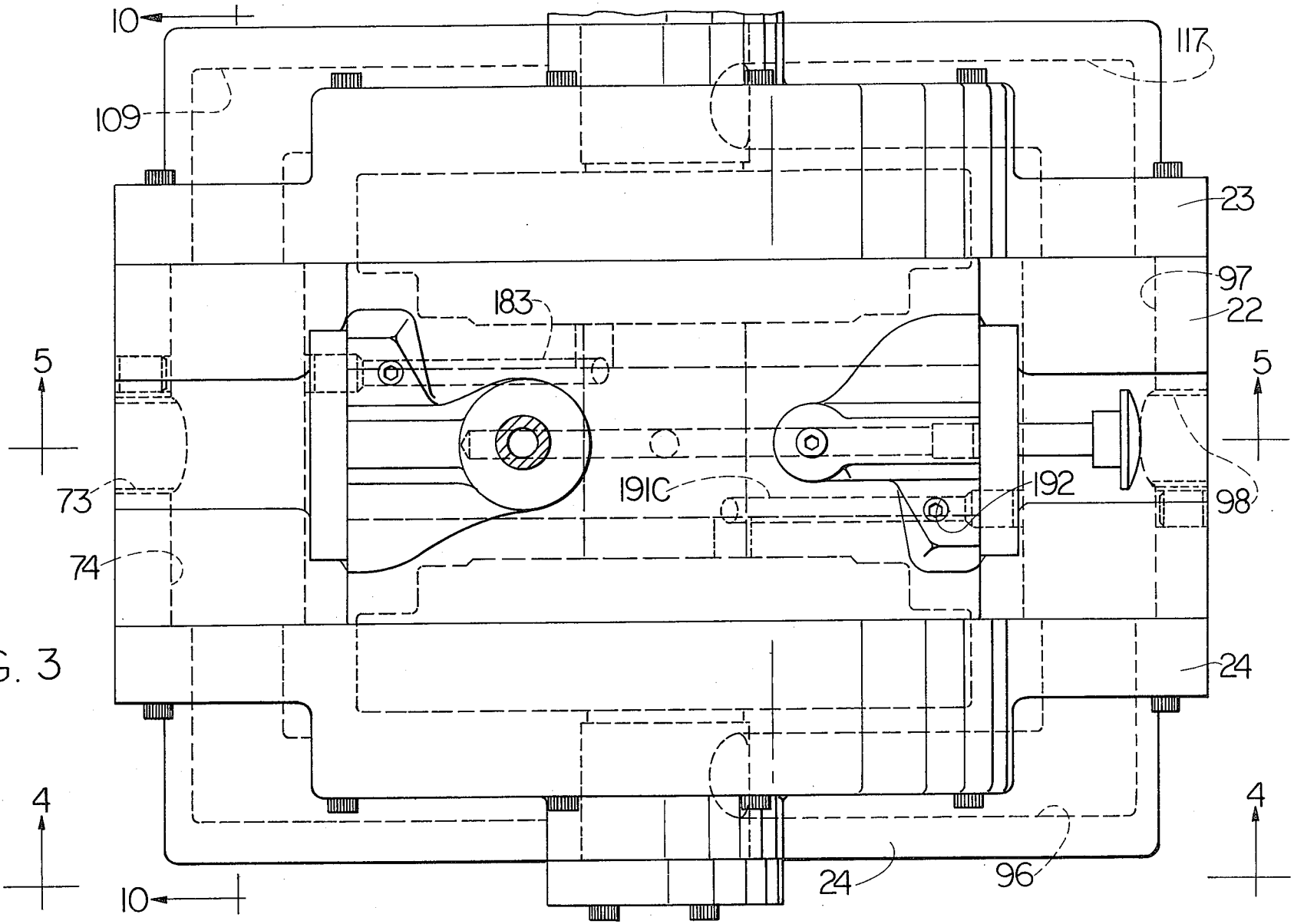
FIG. 3 is a view in section taken on an enlarged scale on the line 3—3 in FIG. 1.
Figure 4:
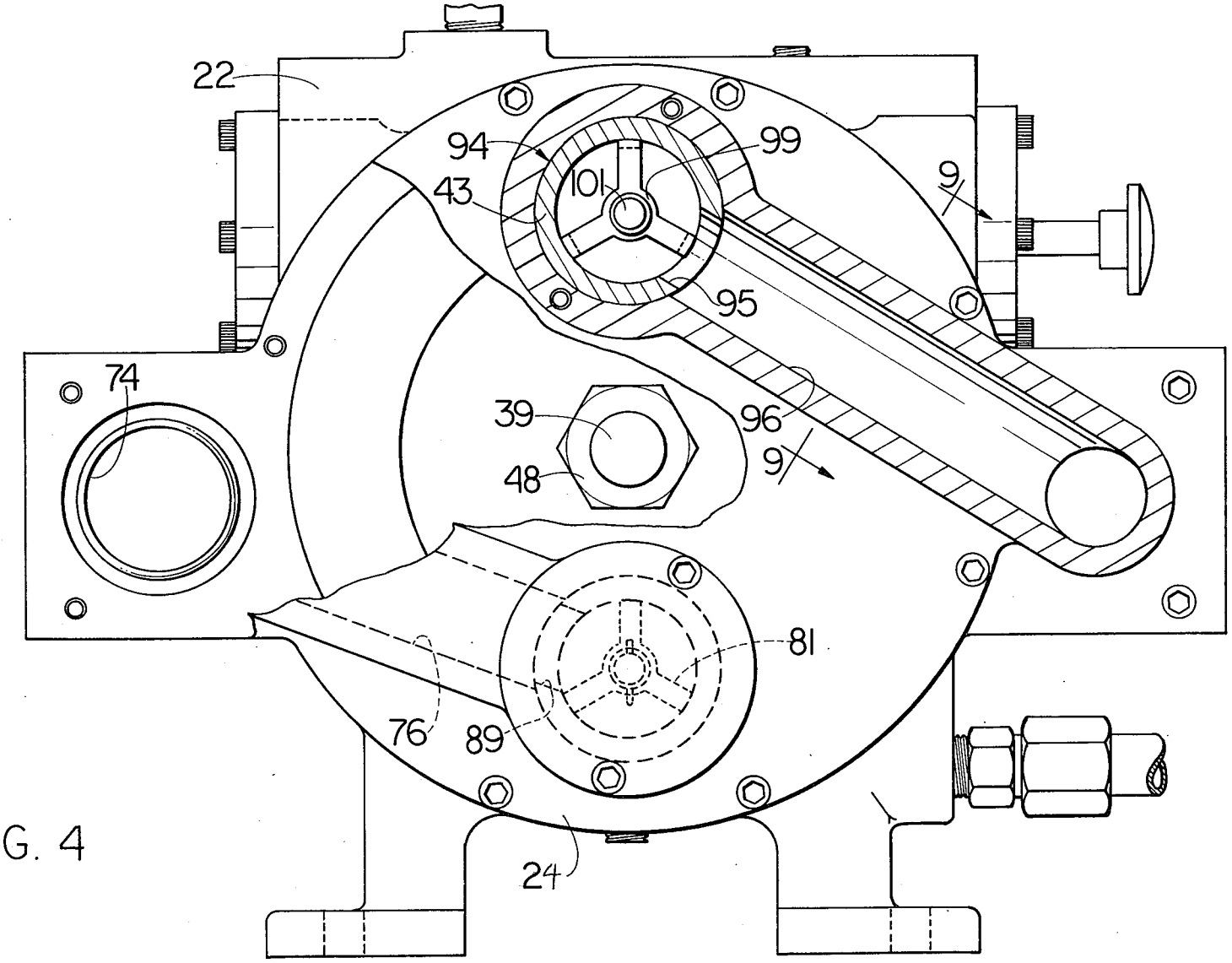
FIG. 4 is a view in side elevation taken in the direction of the arrows 4—4 in FIG. 3, parts being broken away to reveal details of construction.
Figure 10:
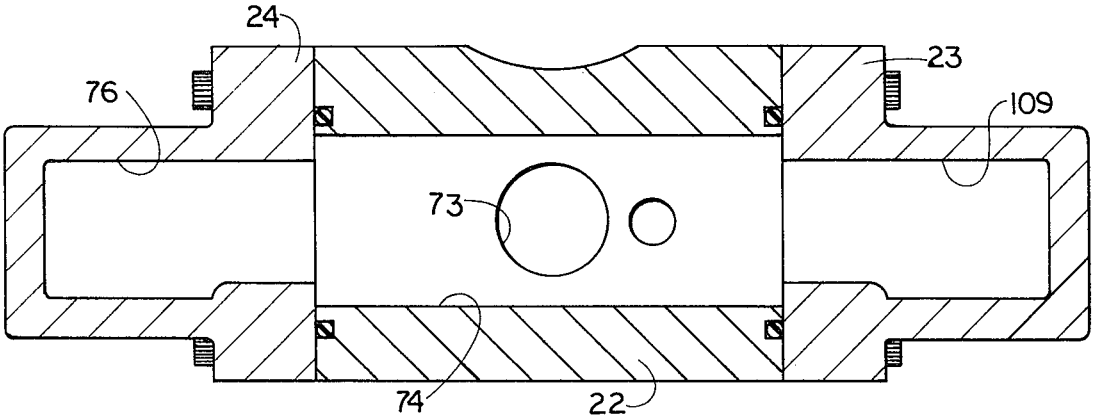
FIG. 10 is a view in section taken on the line 10—10 in FIG. 3.

As the connecting rod 39 moves back and forth between the full line position of FIG. 7 and the dot-dash line position shown at 39A, the discs 42 and 43 and the diaphragm 46 move in a chamber 63 between the housing blocks 24 and 22 which includes a first chamber section 64 in the side housing block 24 and a second chamber section 66 in the central housing block 22. The discs 53 and 54 and the diaphragm 56 move in a chamber 68 which includes a first chamber section 69 in the side housing block 23 and a second chamber section 71 in the central housing block 22. An inlet valve 72 permits entry of liquid to be pumped into the chamber section 64. The liquid to be pumped enters the pump through an inlet port 73 (FIG. 5) in the central housing block 22, travels along a cross channel 74 in the central housing block 22 and through a passage 76 (FIG. 4) in the side housing block 24 to a socket 77 (FIG. 6) in the side housing block 24 which communicates with the chamber section 64. A plug 78 is mounted in the socket 77. An annular valve seat member 79 is mounted in the socket 77. A valve spider 81 is mounted in a skirt portion 82 of the plug 78. The spider 81 guides a valve stem 83. A compression spring 84 mounted on the valve stem 83 and bearing on the spider 81 and on a cotter pin 85 mounted in a transverse bore in the valve stem 83 urges a valve disc 87 of the valve 72 into sealing engagement with the valve seat member 79. When the diaphragm 46 and the discs 42 and 43 move to the right, liquid is drawn from the passageway 76 (FIG. 4) through an opening 89 (FIG. 6) in the skirt 82 and passes the valve 72 into the chamber section 64. When the diaphragm 46 and the discs 42 and 43 are advanced to the left, a valve 91 opens to permit the liquid to pass into the interior of a skirt 93 of a plug 94. The valve 91 communicates with the interior of the chamber section 64 adjacent the top thereof so that any air or other gas which may be caught in the chamber section 64 is discharged therefrom. The liquid passes through an opening 95 (FIG. 4) in the skirt 93 and along a passageway 96 in the side housing block 24, a transverse passageway 97 (FIG. 3) in the central housing block 22 and a discharge opening 98 in the central housing block 22. The valve 91 includes a spider 99 (FIG. 6) mounted inside the skirt 93, which guides a valve stem 101. A valve disc 102 mounted on the valve stem 101 is normally held in sealing engagement with an annular valve seat member 103 by a compression spring 104 mounted on the valve stem 101 and bearing on the spider 99 and on the valve disc 102. The valve seat member 103 is mounted in a socket 106 in the side housing block 24 in communication with the chamber section 64. In a similar manner, when the diaphragm 56 and the discs 53 and 54 move to the left as shown in FIG. 6, a valve 108, only a portion of which is shown, opens to permit liquid from the inlet port 73 (FIG. 10) to pass along the cross channel 74 and along a passageway 109 in the side housing block 23 and a socket 111 (FIG. 6) into the chamber section 69. When the diaphragm 56 and the discs 53 and 54 move to the right, the liquid is directed from the chamber section 69 through a valve 112 (not shown in detail) inside a skirt 113 of a plug 114 through an opening 116 in the skirt 113 and along a passageway 117 (FIG. 3) in the side housing block 23 into the transverse passageway 97 to be discharged through the discharge opening 98.

The pump can be powered by compressed air or the like. The compressed air is introduced through an appropriate fitting 121 (FIG. 5) into a passageway 122, which communicates with an annular slot 123 in the connecting rod 39 through an annular slot 123A and openings 123B in the valve sleeve 31. Compressed air passes through a channel 124 (FIG. 6). The channel 124 communicates with the interior of a lengthwise bore 126 (FIG. 5) in the central housing block 22. A valve sleeve 127 is mounted in the lengthwise bore 126. The channel 124 communicates with an annular groove 129 in the valve sleeve 127. A control valve spool member 131 is mounted inside the valve sleeve 127 for movement lengthwise thereof. The valve spool includes four outwardly extending portions 133, 134, 136 and 137 between which are disposed annular slots 139, 141 and 142. The slot 141 is at all times in communication with the source of compressed air through openings 143 in the valve sleeve 127 which connect the slot 141 and the groove 129. The slots 139 and 142 are at all times connected to an exhaust port 144 through a channel 145, openings 146 and 147 in the valve sleeve 127 and annular grooves 148 and 149 in the valve sleeve 127.

Plugs 150 and 150A attached to the central housing block 22 by fasteners 150B at opposite ends of the lengthwise bore 126 hold the valve sleeve 127 in position in the lengthwise bore 126 and limit lengthwise movement of the valve spool 131.

Figure 12:
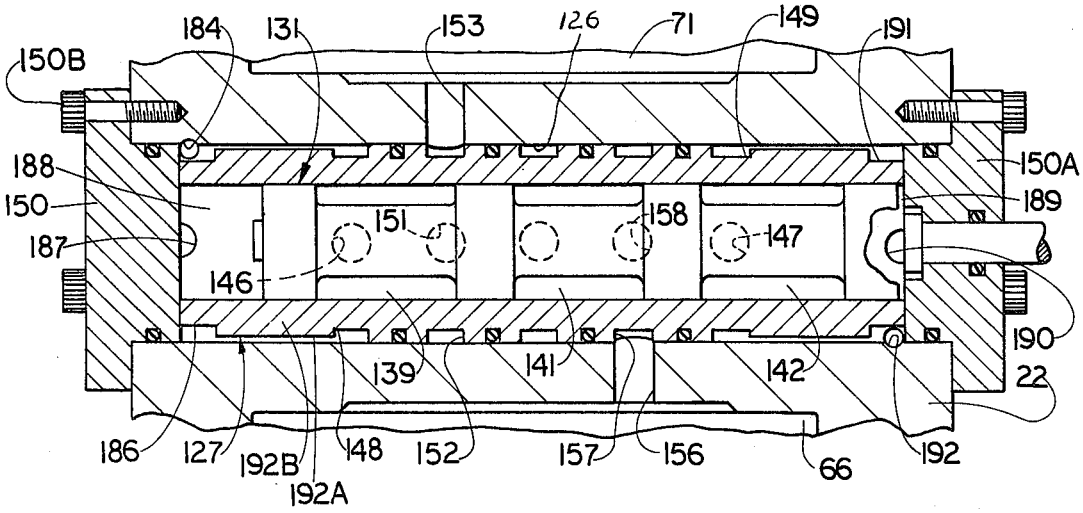
FIG. 12 is a view in section taken on the line 12—12 in FIG. 5, the control valve being shown in its other extreme position.

When the valve spool 131 is in the position shown in FIG. 8, compressed air passes from the channel 124 through the slot 141 and through openings 151 in the valve sleeve 127 and an annular groove 152 in the valve sleeve 127 to an opening 153 in the central housing block 22. As shown in FIG. 12, the opening 153 communicates with the interior of the chamber section 71 so that the connecting rod 39 and associated parts are driven to the right as shown in FIGS. 6 and 7. Air from the chamber section 66 passes through an opening 156 (FIG. 12) in the central housing block 22 and through an annular groove 157 and openings 158 in the valve sleeve 127 into the slot 142 (FIG. 8) and from the slot 142 through the openings 147 and the annular groove 149 in the valve sleeve 127 and the channel 145 to the exhaust opening 144. When the valve spool 131 is in the position shown in FIG. 12, compressed air from the channel 124 (FIG. 8) passes through the slot 141 and through the openings 158 in the valve sleeve 127 and the annular groove 157 in the valve sleeve 127 to the opening 156 (FIG. 12) in the central housing block 22 to supply pressure to the chamber section 66 causing the connecting rod 39 and associated parts to be driven to the left as shown in FIGS. 6 and 7. Air from the chamber section 71 passes through the opening 153 (FIG. 12) and through the annular groove 152 and openings 151 in the valve sleeve 127 into the slot 139 and from the slot 139 through the openings 146 and the annular groove 148 in the valve sleeve 127 and the channel 145 (FIG. 5) to the exhaust port 144.

Resilient cylindrical bumper members 161 and 162 (FIG. 8) of rubber or other rubber-like material are mounted in sockets 163 and 164, respectively, in opposite end portions of the valve spool 131. The bumper 161 is engageable with the plug 150 to prevent engagement of an end face 166 of the valve spool 131 with the plug 150 and to resiliently limit movement of the valve spool 131 to the left. The bumper 162 is engageable with a head 167 (FIG. 5) of a plunger 168 to limit movement of the valve spool 131 to the right. The plunger 168 is slidably mounted in the cap 150A and can be moved to the left as shown in FIG. 5 to engage the bumper 162 to move the valve spool 131 to the left when necessary at the time operation of the pump is started.

The connecting rod 39 (FIG. 7) includes enlarged portions 172 and 173 which slide inside a central bore 174 of the valve sleeve 31 and define the slot 123. The valve sleeve 31 includes annular slots 175 and 176. The slot 175 communicates with the interior of the central bore 174 of the valve sleeve 31 through openings 179. The slot 176 communicates with the interior of the central bore 174 through openings 181. When the connecting rod reaches the position shown in full lines in FIG. 7, at which it is in its extreme right position, compressed air from the passageway 122 passes through the slot 123, the openings 181, and the slot 176 into a horizontal passageway 183 which communicates with an upright passageway 184. As shown in FIG. 12, the upright passageway 184 communicates with an annular slot 186 adjacent a left hand end of the valve sleeve 127 and through slots 187 in the sleeve 127 with an enclosed space 188 inside the sleeve 127 between the left hand end of the spool valve 131 and the plug 150. The pressure causes the valve spool 131 to move to the FIG. 12 position, whereupon the connecting rod 39 (FIG. 7) and associated parts are caused to move to the left. A second enclosed space 189 (FIG. 8) is formed inside the valve sleeve 127 between the right hand end of the valve spool 131 and the cap 150A. The enclosed space 189 communicates through slots 190 with an annular slot 191 in the sleeve 127. The slot 191 communicates with the slot 149 and with the exhaust channel 145 (FIG. 5) through an annular metering opening 191A (FIG. 8) between an annular shoulder 191B on the sleeve 127 and the interior of the bore 126 so that air can escape from the space 189. When the connecting rod reaches the position shown in dot-dash lines at 39A in FIG. 7, air from the passageway 122 is directed through the openings 179 and the slot 175 to a horizontal passageway 191C (FIG. 3) and an upright passageway 192 to the annular slot 191 at a right hand end of the valve sleeve 127 as shown in FIG. 12 through the slots 190 in the valve sleeve 127 into the space 189 between the plug 150A and the right hand end of the valve sleeve 127 to cause the valve spool 131 to move to the left. An annular metering opening 192A between an outwardly extending shoulder 192B of the valve sleeve 129 and the interior of the bore 126 permits air from the space 188 to be exhausted through the openings 146 and the slot 148 to the exhaust channel 145 (FIG. 5).

Figure 5:
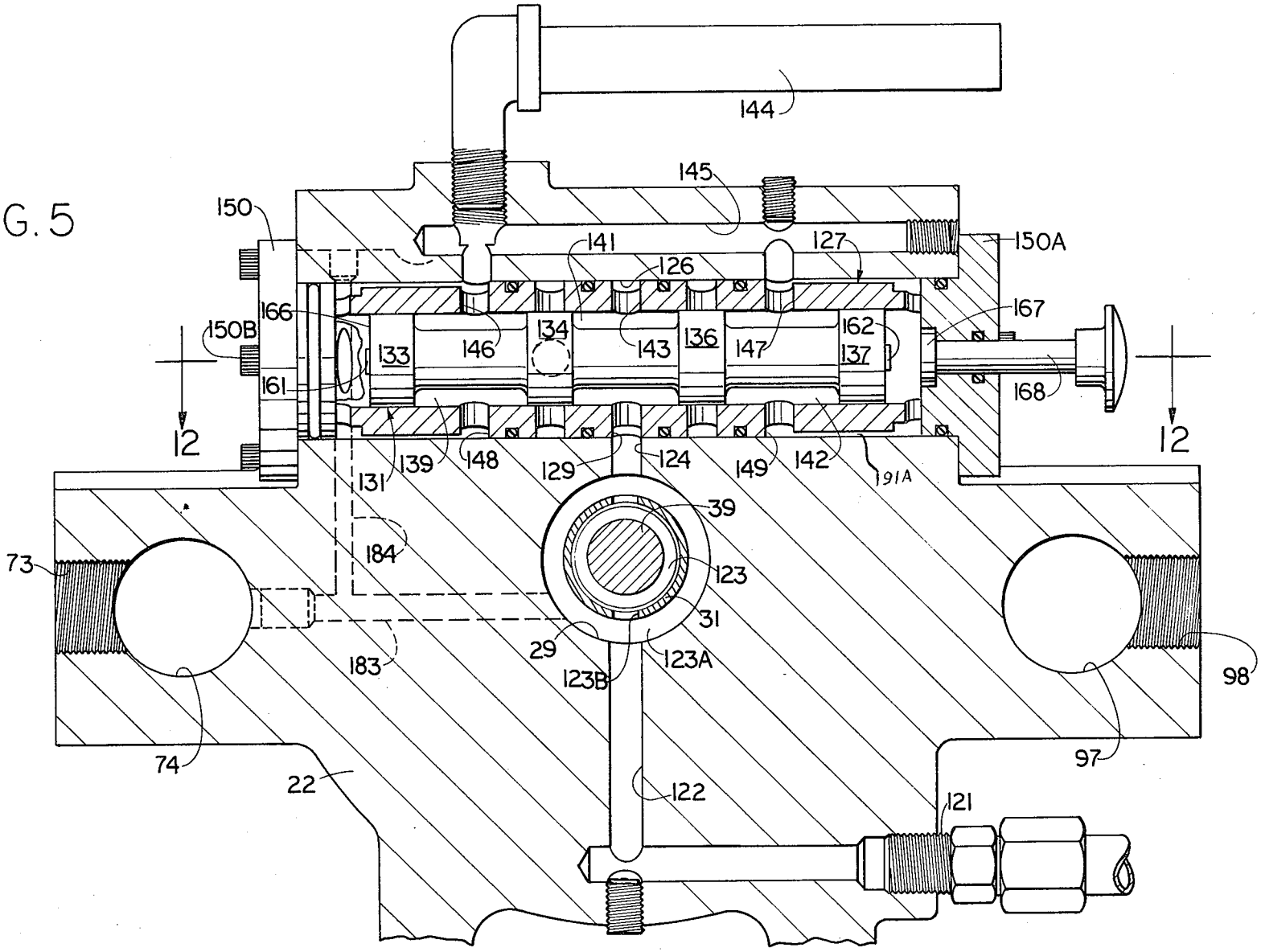
FIG. 5 is a view in section taken on the line 5—5 in FIG. 3, a part of a valve sleeve being broken away to reveal details of structure.
Figure 6:
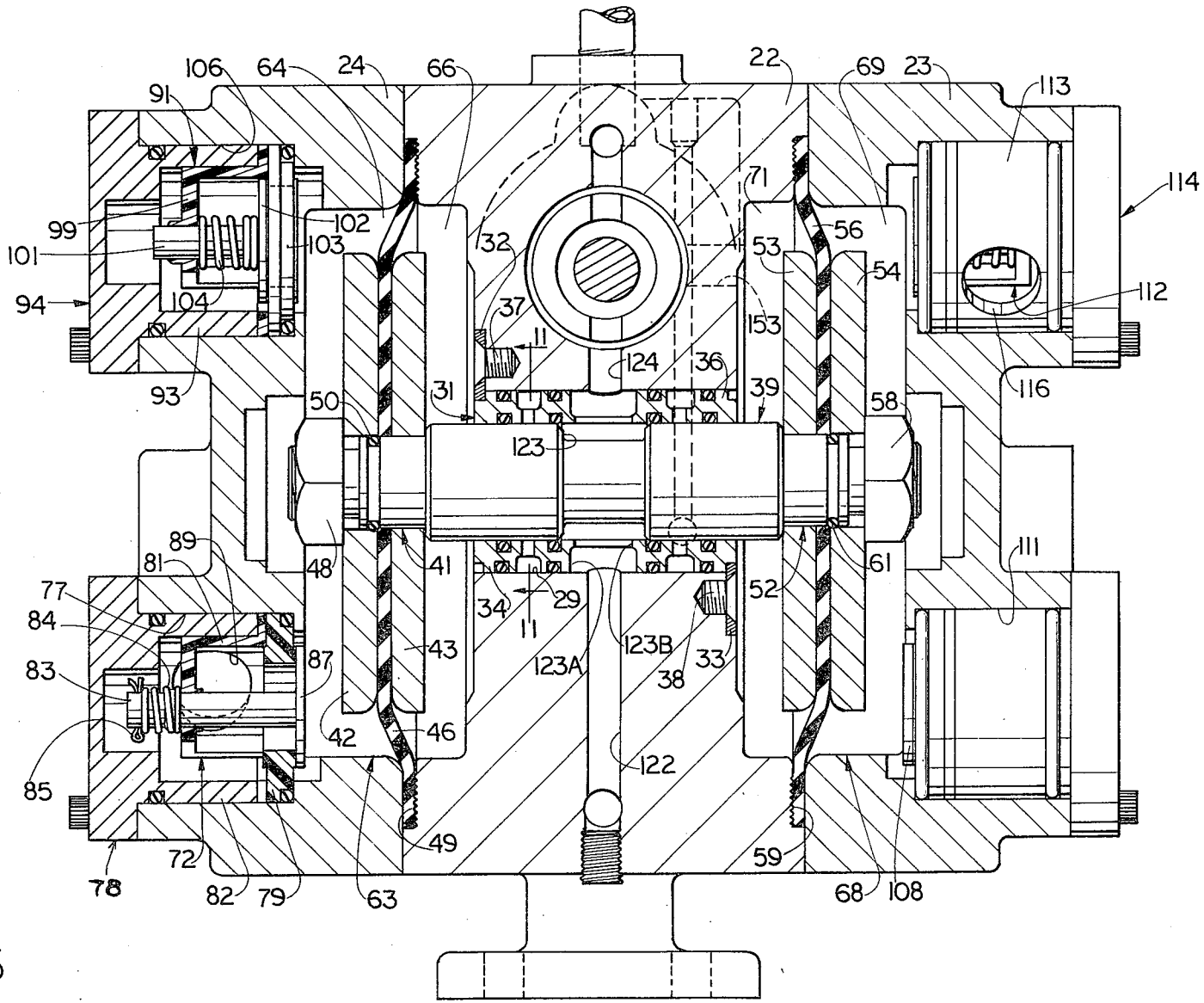
FIG. 6 is a view in section taken on an enlarged scale on the line 6—6 in FIG. 1.
Figure 9:
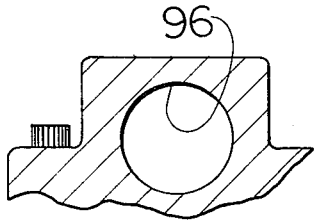
FIG. 9 is a fragmentary view in section taken on the line 9—9 in FIG. 4.
Figure 11:
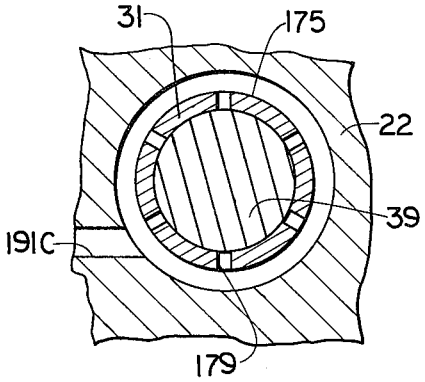
FIG. 11 is a view in section taken on the line 11—11 in FIG. 6.

When the pump is to be used, the plunger 168 is pushed inwardly to move the spool valve 131 to the left as shown in FIG. 5 to its left hand extreme or limit position as shown in FIG. 8. When air under pressure is introduced through the fitting 121, the pressure operates as indicated by arrows in FIG. 8 to cause the connecting rod 39 and associated parts to move to the right as shown in FIG. 7. When the connecting rod 39 and associated parts reach their extreme right position as shown in FIG. 7, the control valve spool 131 (FIG. 8) is moved to the right as shown in FIG. 8, and the connecting rod and associated parts move to the left as shown in FIG. 7 until the other extreme or limit position is reached, whereupon the control valve spool 131 is returned to the left, and the pump operates continuously as long as supplied with air under pressure.

The pump illustrated in the drawings and described above is subject to structural modification without departing from the spirit and scope of the appended claims.

Having described my invention, what I claim as new and desire to secure by letters patent is:

1. In combination with a two-stage pump which includes a pair of reciprocating pump members operating in opposed pump chambers and a connecting rod connecting the pump members to cause the pump members to operate in unison, a control valve for supplying air under pressure to said pump chambers which comprises a spool valve member, a guide sleeve guiding said spool valve member for reciprocation, said spool valve member including an inner pair of outwardly extending portions defining a central pressure slot and an outer pair of outwardly extending portions, each of the outer pair defining an exhaust slot with one of the inner pair, means in the sleeve for connecting the central pressure slot with a source of air under pressure, means in the sleeve for releasing pressure in each of the exhaust slots, a first port in the sleeve communicating with a first one of the chambers, a second port in the sleeve communicating with the other of the chambers, the spool valve member moving between a first limit position in which the first port is in communication with the pressure slot and the second port is in communication with one of the exhaust slots to cause movement of the connecting rod and the pump members in one direction and a second limit position in which the second port is in communication with the pressure slot and the first port is in communication with the other of the exhaust slots to cause movement of the connecting rod and the pump members in an opposite direction, there being pressure chambers at opposite ends of the sleeve member, means controlled by the connecting rod for supplying air under pressure to one of said pressure chambers when the connecting rod is in one position to cause movement of the spool valve member toward the other of said pressure chambers, means controlled by the connecting rod for supplying air under pressure to the other pressure chamber to cause movement of the spool valve member toward the first pressure chamber when the connecting rod is in a second position, and means releasably engageable with the spool valve member for advancing the spool valve member to one of the limit positions to position the spool valve member for starting the pump, there being metering air passageways exhausting air from the pressure chambers.

2. A combination as in claim 1 wherein there are resilient bumper members mounted on opposite end portions of the spool valve member which resiliently limit movement thereof, and the means engageable with the spool valve member is a plunger movable axially thereof and releasably engageable with an end thereof, one of said bumper members being engageable with the plunger to advance the plunger to a retracted position.

3. A combination as in claim 1 wherein the means engageable with the spool valve member is a plunger movable axially thereof and releasably engageable with an end thereof.

* * * * *